US005090686A

United States Patent [19]

Kemp et al.

[11] Patent Number: 5,090,686

[45] Date of Patent: Feb. 25, 1992

[54] PAPER GUIDE WHEEL

[76] Inventors: Norman H. Kemp, 3216 Oakdale Dr., Hurst, Tex. 76054; James R. Kemp, 1004 Billie Ruth, Hurst, Tex. 76053

[21] Appl. No.: 501,019

[22] Filed: Mar. 29, 1990

Related U.S. Application Data

[60] Division of Ser. No. 281,521, Dec. 8, 1988, Pat. No. 4,973,040, which is a continuation of Ser. No. 152,896, Feb. 5, 1988, abandoned.

[51] Int. Cl.[5] ..... B65H 5/02

[52] U.S. Cl. ..... 271/277; 101/422; 101/419

[58] Field of Search ..... 271/277, 275, 82, 204, 271/205, 206; 221/218; 101/422, 419, 416.1, 418

[56] References Cited

U.S. PATENT DOCUMENTS 687,575 11/1901 Roesen ..... 101/422
2,410,611 11/1946 Pratt et al. ..... 271/275
3,642,274 2/1972 Herrington et al. ..... 271/277
3,918,707 11/1975 Villemer et al. ..... 271/277
4,691,632 9/1987 DeMoore ..... 101/419

*Primary Examiner*—Robert P. Olszewski
*Assistant Examiner*—Kenneth Noland
*Attorney, Agent, or Firm*—Jack A. Kanz

[57] ABSTRACT

A paper guide wheel for printing presses is formed to include an outer surface eccentric with respect to the axis of rotation of the wheel so as to form an air gap between the outer surface of the wheel and the paper as the paper is drawn thereover during movement through the press. The air gap gradually narrows as the wheel turns, allowing the freshly inked surface of the paper to gently nest against the outer surface at a point removed from the leading edge of the paper. The outer surface has a slightly convex contour in the axial direction to avoid marking of the paper by contact with the axial extremes of the outer surface. Foam material may be provided on the wheel rim to assist in supporting the paper without marking the freshly inked image.

20 Claims, 6 Drawing Sheets

PAPER GUIDE WHEEL

This application is a division of application Ser. No. 281,521 filed Dec. 8, 1988 now U.S. Pat. No. 4,973,040 which is continuation-in-part of application Ser. No. 07/152,896 filed Feb. 5, 1988, now abandoned.

FIELD OF THE INVENTION

This invention relates generally to paper guide wheels for printing presses. More particularly, it relates to improved paper guide wheels having a paper-supporting rim which makes minimal, non-smearing contact with freshly inked surfaces of paper moving through the press.

BACKGROUND OF THE INVENTION

In high speed presses or in those in which the paper changes direction one or more times for the purpose of making the machine more compact, guide wheels are employed to aid in changing the direction of movement of the paper. The wheels may be arranged between stages of a multiple color press and/or may be deployed where the paper leaves the last impression cylinder and passes into a paper delivery system to be transported to a paper stack. If the wheels engage the paper in wet ink areas, smearing of ink and marring of the resulting print can occur. In an effort to avoid smearing the ink, which is typically wet from previous printing steps, it has been the practice to position the guide wheels to avoid the wet ink areas. To this end the guide wheels are constructed to permit repositioning along a supporting shaft to miss any of the wet surfaces and thus avoid marking or smearing the ink on the paper. However, it is often not possible to position the guide wheels to avoid all contact with freshly inked areas of the paper. Also, even when repositioning of guide wheels would avoid contact with freshly inked areas of the paper, it maybe impractical to effect the repositioning due to the high cost of press down-time.

Many attempts have been made to avoid (to the extent possible) contact between the wheels and the paper as it moves around the wheels to change direction. Some prior solutions have included placing cloth or blotter material on the periphery of the wheels, placing relatively thick spacers along the wheels to avoid touching the ink, and constructing wheels with serrations on the outer periphery so that as little contact as possible occurs between the paper and the wheels.

A particular problem manifested by prior art guide wheels is the problem of leading edge marking. Guide wheels are typically provided with an opening or notch in the rim which supports the paper. The purpose of the opening is to receive a gripper mechanism which grips the front edge of the paper sheet as it is about to be pulled around the guide wheel. Immediately following the gripper mechanism is the leading edge of the paper-supporting rim of the guide wheel. There is an inherent tendency for this leading edge of the rim to mark the freshly inked surface of the paper. U.S. Pat. No. 3,791,644 recognizes this problem and discloses providing an inwardly tapered leading edge having a radius smaller than the remainder of the paper-supporting surface. Although this technique may eliminate marking at the leading edge per se, it instead has been found to cause marking at the point where the taper ends and the constant radius portion of the rim begins. It is believed that support for the paper is concentrated at the point where the abrupt change in curvature occurs.

An additional problem sometimes occurs during printing. As the paper is pulled around the wheels, the flexibility of the freshly inked paper permits the paper to sag between the wheels bringing the paper into engagement with the edges at the axial extremes of the rims of the wheels. Some prior art guide wheels avoid such edge marking by providing guide wheels in the form of cylinders extending the entire width of the paper. See, for example, the aforementioned patent and U.S. Pat. No. 4,402,267. Such long, cylindrical guide wheels (or "skeleton wheels") unavoidably contact parts of the freshly inked paper but employ ink-repellent materials on the paper supporting surfaces to avoid smearing the ink. U.S. Pat. No. 3,791,644 discloses coating the outer surface of the wheel with polytetrafluoroethylene (i.e., the material sold under the trademark TEFLON). U.S. Pat. No. 4,402,267 discloses use of a loosely woven fabric on the paper-supporting surface of the wheel, the fabric having been treated with a liquid repellant material such as that sold under the trademark SCOTCHGARD. The present invention takes a different approach to solving such ink smearing problems.

SUMMARY OF THE INVENTION

The guide wheels of the present invention are constructed to minimize contact with the freshly inked paper passing thereover. Where contact with paper does occur, smearing of ink is substantially eliminated by the inventive techniques described herein.

The guide wheels of the present invention are spaced along a supporting shaft driven by the press. Each guide wheel has a peripheral rim portion and a central hub portion. The shaft passes through a bore in the hub portion defining the axis of rotation of the wheel. Each guide wheel has an opening or notch extending through the rim toward the hub for receiving a gripper bar of the paper delivery system. Leading and trailing edges of the outer surface of the rim are defined where the notch interrupts the rim.

The guide wheel is constructed such that the leading edge, or a point on the outer surface not far from the leading edge, is radially closer to the axis of rotation than other points on the outer surface. From this point of shortest radius, the radial spacing from the axis of rotation to points on the outer surface increases gradually and uniformly in moving a substantial distance around the wheel away from the leading edge. This structure causes an air space of varying dimensions to be formed between the outer surface of the rim and the paper. As the paper is pulled around the underlying rotating wheel, the air space becomes gradually thinner until the paper gently nests against the outer surface.

In accordance with another aspect of the invention the paper-supporting outer surface of the guide wheel is constructed with a slightly convex profile or crown extending the axial width of the wheel. This contour configuration eliminates the edge marking effect found to occur due to sagging of the paper between guide wheels.

In accordance with another aspect of the invention the rim of the guide wheel includes a layer or layers of foam or the like which make non-smearing contact with freshly inked surfaces of the paper.

In accordance with another aspect of the invention a dual-notched guide wheel is made by forming an eccentric bore in the hub of a wheel, separating the wheel along a diameter, and reversing and reconnecting the halves to provide two eccentric paper-supporting surfaces.

The foregoing and additional features and advantages of the invention will become more apparent as the following detailed description is read in conjunction with the accompanying drawing wherein similar reference characters denote similar parts in all views and wherein:

DETAILED DESCRIPTION

Figure 1:
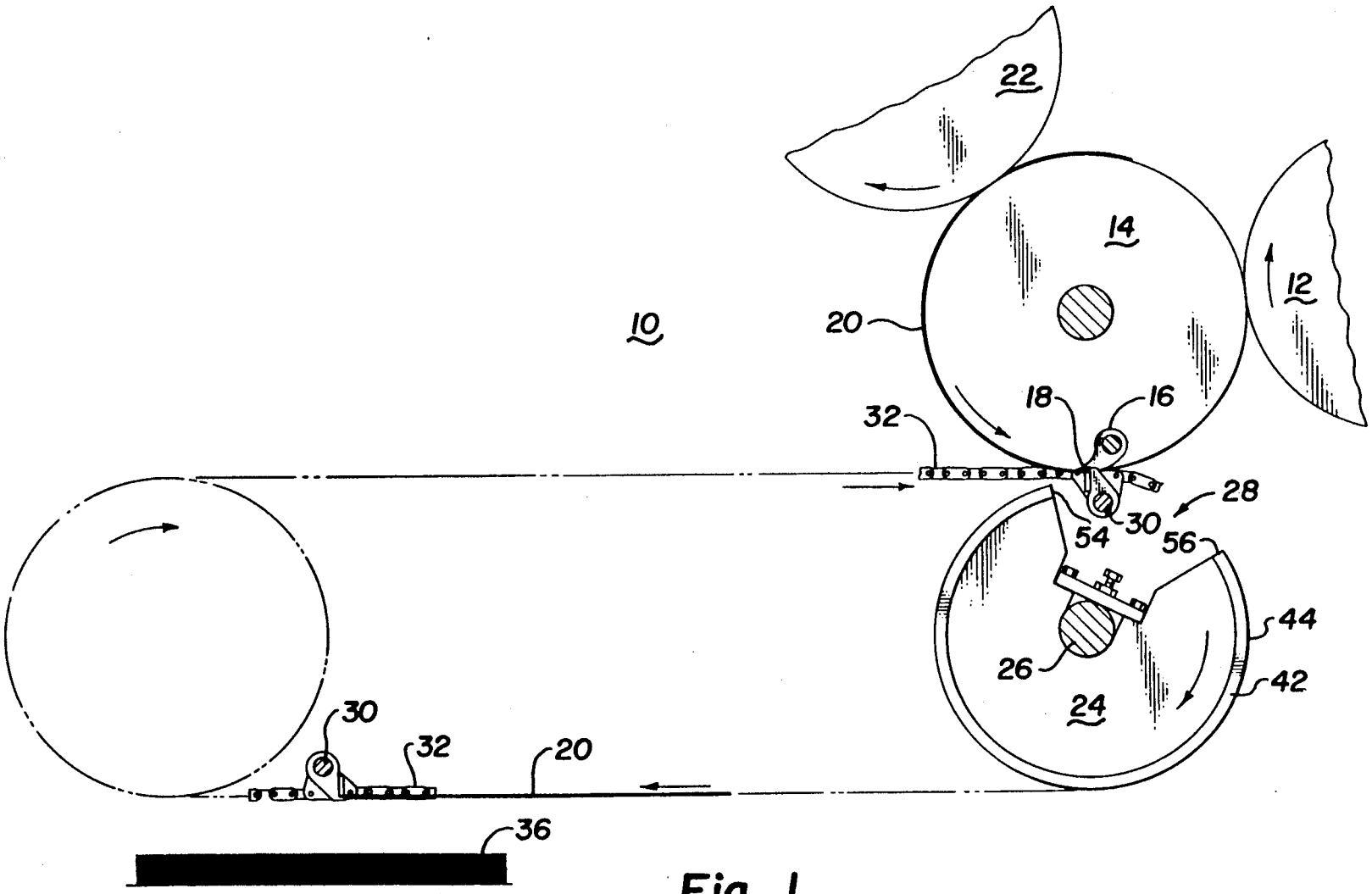
FIG. 1 is a side schematic view of a portion of a printing press illustrating a paper guide wheel constructed in accordance with the invention.

Referring to the drawing and to FIG. 1 in particular, a portion of a printing press is shown and generally designated by reference numeral 10. The press 10 includes a transfer drum or cylinder 12 leading to an impression cylinder 14 which may be one of several similar cylinders in a multistage press. The impression cylinder 14 carries a gripper mechanism 16 which engages and holds the leading edge 18 of a sheet of paper 20 going through the press to be printed. As the sheet 20 is drawn between a blanket cylinder 22 and the impression cylinder 14, the desired inked image is printed on the paper in accordance with known techniques.

The press 10 also includes one or more paper guide wheels 24 which rotate on a shaft 26 driven by the press. Each wheel 24 is provided with an opening or notch 28 which functions to receive gripper bars 30 carried by sheet delivery chains 32 for moving the paper onto a stack 36. The orientation of the cylinder 14 and guide wheel 24 in this view is at the point in time when the leading edge 18 of the paper has arrived at the transfer point where it leaves the cylinder 14 and is picked up by the gripper element on the bar 30 for movement around the guide wheel 24.

Figure 2:
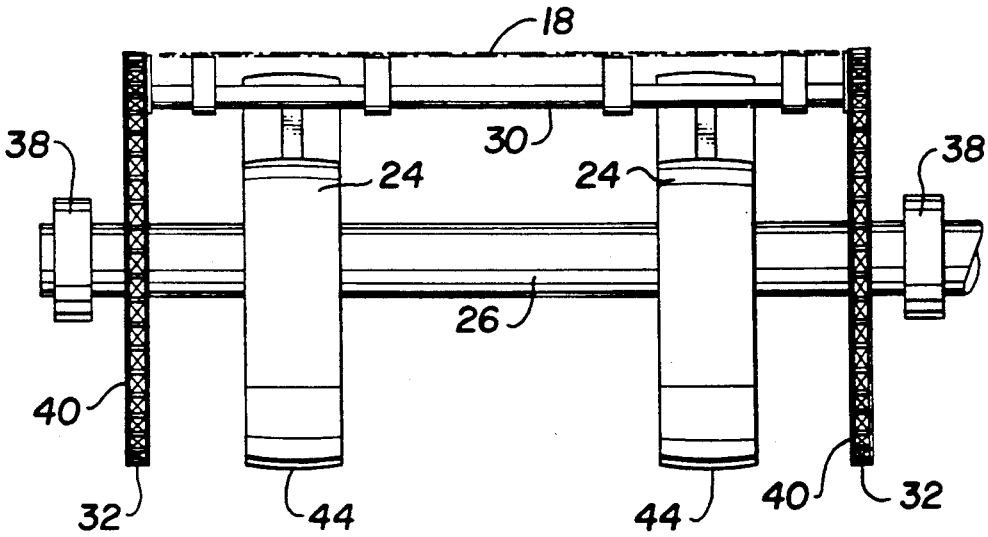
FIG. 2 is an end view of a portion of the press of FIG. 1 showing the relationship between two guide wheels on a supporting shaft.

As depicted in FIG. 2 the shaft 26 extends transversely across the press and is journaled therein by bearings 38 at each end. Although two paper guide wheels 24 are shown spaced along the shaft 26, the exact number which may be employed depends upon the width of the press and the width of each wheel. The chains 32 are driven by sprockets 40 which are located near each end of the shaft 26 and which rotate at the same speed as the guide wheels 24.

Figure 3:
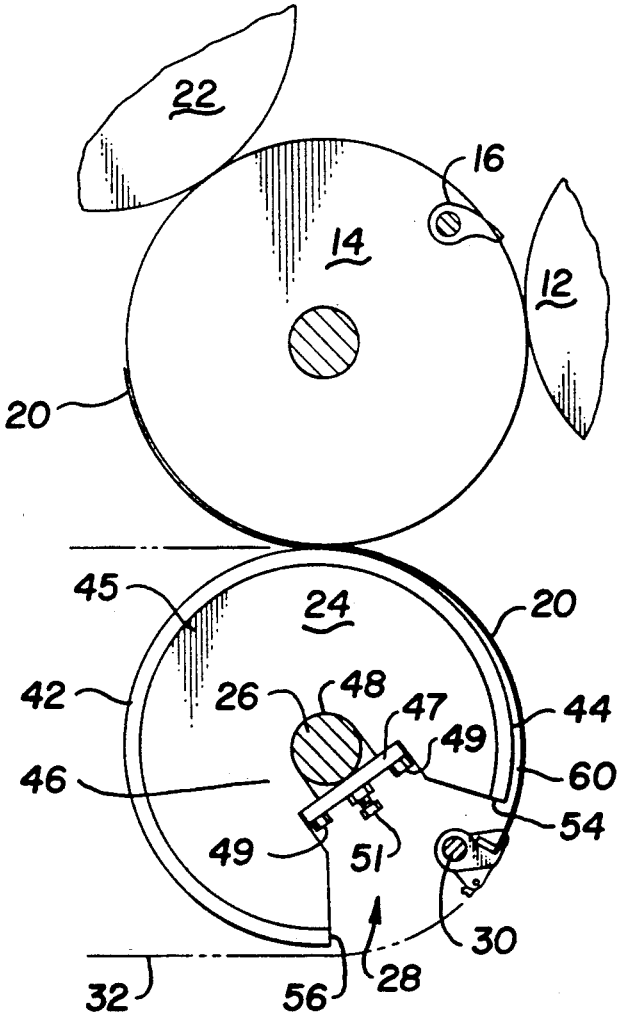
FIG. 3 is a partial side view of the press of FIG. 1 showing the progression of the paper around the guide wheel.

In FIG. 3 the wheel 24 is shown rotated clockwise approximately one hundred and twenty degrees from the position shown in FIG. 1. The wheel 24 has a rim 42 which defines an outer surface 44. A web portion 45 extends from the rim 42 to a central hub portion 46 which has a bore 48 for receiving the shaft 26. The web portion 45 and hub portion 46 are shown as a continuous radial plate. However, it will be appreciated that a lighter wheel can be constructed if desired by providing a spoked or otherwise discontinuous web portion. The portions of the wheel 24 which define the notch 28 include a leading edge 54 and a trailing edge 56, both extending from the rim 42 radially inward.

Optimum positioning of the guide wheels 24 along the shaft 26 is readily achieved by the structure shown. A clamp bar 47 extends across the hub portion 46 and abuts the shaft 26. The clamp bar 47 is secured to the hub portion 46 by any suitable means such as threaded fasteners 49. In order to secure the wheel 24 to the shaft 26, a set screw 51 extends through a threaded opening in the bar 47. Tightening the set screw 51 causes it to engage the shaft 26 and secure the wheel 24 for rotation with the shaft.

In accordance with an important feature of this embodiment, the bore 48 is located slightly off center with respect to the center of the wheel 24 so that the leading edge 54 is moved slightly inward from the paper 20, providing a gap or air space 60 between the outer surface 44 of the wheel and the paper 20. With such construction the axis of rotation of the wheel is offset from the natural center defined by the outer circular surface 44 the of the wheel 24. The diameter of the wheel 24 must also be reduced by the offset distance for reasons discussed below. An offset of 0.150 inch has been found to be optimum for both eight inch and sixteen inch diameter wheels with a range of about 0.125 to about 0.175 inch providing acceptable results.

In the embodiment of FIG. 3 the line which passes through the center of the bore 48 and the center of the wheel 24 also passes through the leading edge 54. Thus the leading edge 54 is the closest point on the outer surface 44 to the axis of rotation and the gap 60 is greatest at the leading edge 54. The resulting eccentric arrangement eliminates leading edge marking and provides a second favorable result. The gap 60 gradually narrows as the wheel 24 and paper 20 rotate together, allowing the paper 20 to gently nest against the outer surface 44 at a point removed from the leading edge 54 by as much as one hundred and eighty degrees from the leading edge 54, thus minimizing ink marking problems. As mentioned above, the diameter of the wheel 24 in this eccentric arrangement must be reduced by an amount at least equal to and preferably slightly more than the offset distance when compared to a standard concentric wheel. If this is not done the high side of the wheel 24 opposite the leading edge 54 will interfere with the impression cylinder 14, preventing rotation of the wheel 24.

It is believed that optimum dimensions for eccentric guide wheels made in accordance with the invention will be discovered in the course of further experimentation. By way of example, in a press where the leading edge 18 of the paper follows a semicircular path of five inches in radius as it is pulled around the guide wheel, a wheel having the following dimensions demonstrated superior results. A wheel blank having a diameter of 9.32 inches was constructed with an offset bore providing an axis of rotation spaced from the natural center of the wheel 0.15 inch closer to the outer surface 44 along the radius passing through the leading edge 54 of the wheel. This construction results in an air gap between the leading edge of the wheel and the theoretical path of the paper measuring 0.49 inch. The high point of the outer surface of the wheel, which is one hundred and eighty degrees around the wheel from the leading edge 54, travels in a circular path 0.19 inch within the semicircular path traveled by the leading edge of the paper. In operation the full length of the paper sheet does not follow the semi-circular path of its leading edge. Instead, tension on the paper sheet causes it to move slightly inside this semicircular path and gradually nest against the outer surface of the wheel at a point substantially removed from the leading edge 18 of the paper.

Figure 3A:
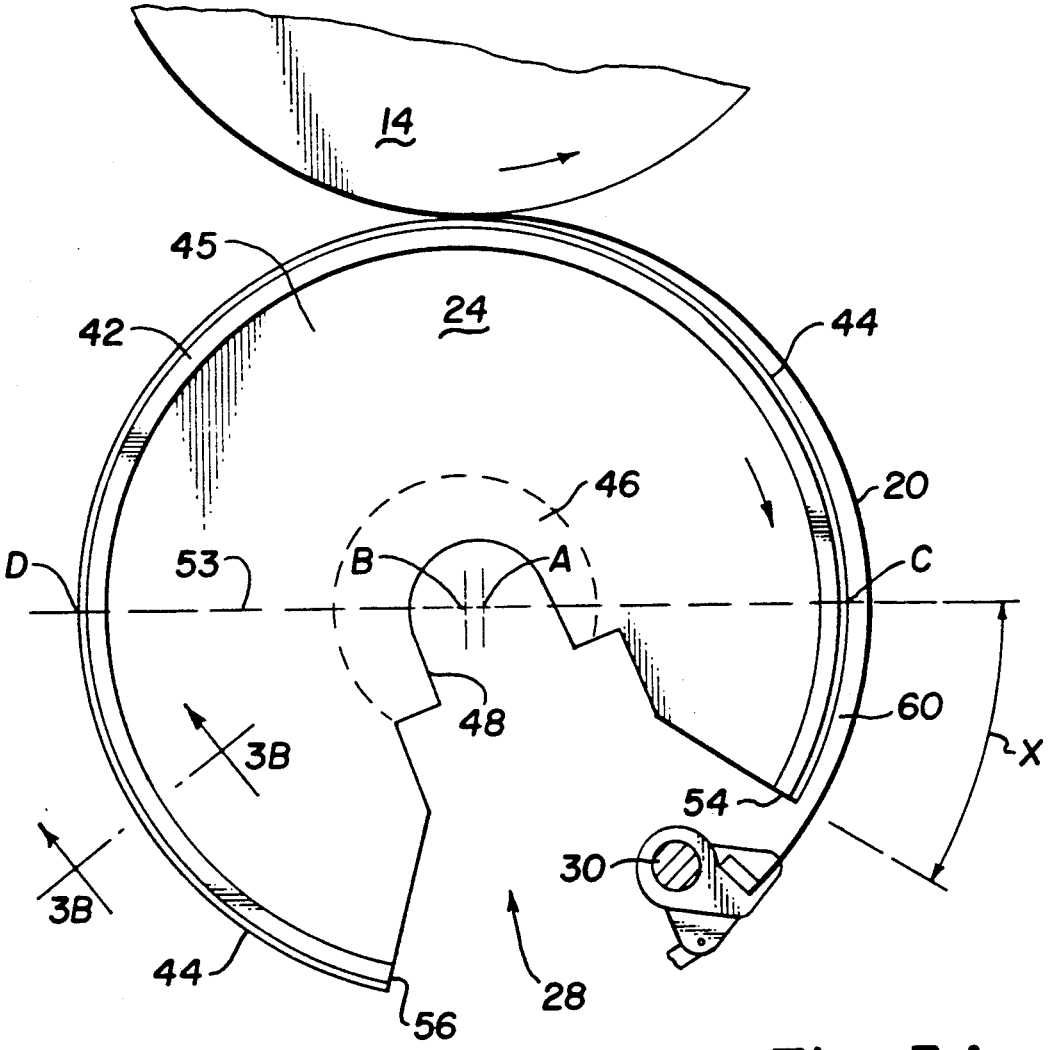
FIG. 3A is an enlarged view of a modified guide wheel similar to the guide wheel of FIG. 3.
Figure 3B:
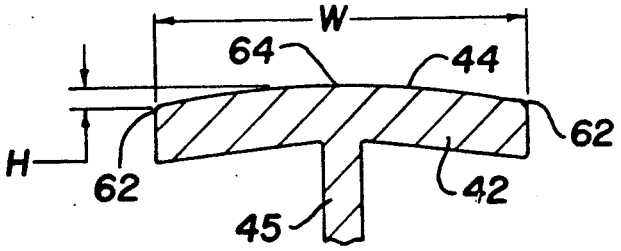
FIG. 3B is a cross-sectional view of a rim portion of the guide wheel shown in FIG. 3A.

With reference to FIGS. 3A and 3B, a slightly modified version of the guide wheel 24 is illustrated with the same reference numerals designating the same or similar parts. In FIG. 3A the hub portion 46 is designated for clarity as the central portion within the dashed circular arc. Also, for ease of illustration the shaft assembly has been left out of the figure. The U-shaped bore 48 is seen to be offset slightly within the hub 46. The curved portion of the bore defines a semicircle having a center A. A second center B defines the center of the outer surface 44 of the guide wheel 24. The two centers A and B are separated by an offset distance of preferably about 0.150 inch as previously mentioned. The center A also represents the center of the shaft when mounted in the bore 48. Thus the center A defines the axis of rotation of the guide wheel 24. Accordingly, the outer surface 44 of the guide wheel 24 is eccentric with respect to the axis of rotation of the wheel 24.

Both centers A and B lie on diameter line 53 which intersects the outer surface 44 at points C and D. This embodiment differs from the embodiment of FIGS. 1 and 3 in that point C rather than the leading edge 54 is the closest point on the outer surface 44 to the axis of rotation. In this embodiment the gap 60 between the paper 20 and the outer surface 44 is widest at point C.

Point C is located at a distance from the leading edge 54 defined by angle X. The purpose of this arrangement is to move point D farther around the wheel from the leading edge 54. Point D represents the point on the outer surface 44 farthest from the axis of rotation and thus is most likely to contact the paper 20. By moving point D farther around the wheel 24, the paper is given more opportunity to gradually nest against the outer surface 44. A preferred angle X of about thirty to forty-five degrees achieves the desired result while still maintaining adequate separation between the leading edge 54 and the paper 20 to avoid leading edge marking. The result achieved is relocation of the high point D to a position about two hundred and ten to about two hundred and twenty-five degrees from the leading edge 54.

As the wheel rotates, the trapped air in the air space 60 forms a cushion between the paper and the outer eccentric surface 44 of the wheel rim 42. It is believed that the existence of this air cushion keeps the wheel from marking the freshly inked surface of the paper. As the wheel rotates farther, the air space 60 narrows and the paper 20 gently nests on the surface 44.

It will be appreciated that the sheets 20 may be somewhat flexible, particularly when wet with ink. Accordingly, as the gripper bar 30 pulls the sheet 20 around the wheels 24, some sagging of the sheet 20 between the wheels 24 may occur. It is known that prior art wheels with cylindrical outer surfaces have a tendency to mark freshly inked paper at the outer edges of the rims due to this sagging effect.

An effective solution to this problem is to provide a slightly convex or crowned outer surface 44 as shown somewhat exaggerated in FIG. 3B. A preferred shape for the crowned surface 44 is that which approximates the degree of paper sag and thus avoids edge marking at edges 62. However, the height of the convex arc or crown should not be so pronounced as to displace the air cushion between the middle 64 of the rim and the paper or permit contact with the paper to occur only at points around the middle of the rim 42. For a wheel width W of four inches, a crown height H of 0.04 inches has been found to accomplish the aforementioned objectives. It is believed that approximately the same 100:1 ratio of width to height will achieve the desired results regardless of wheel width.

Figure 4:
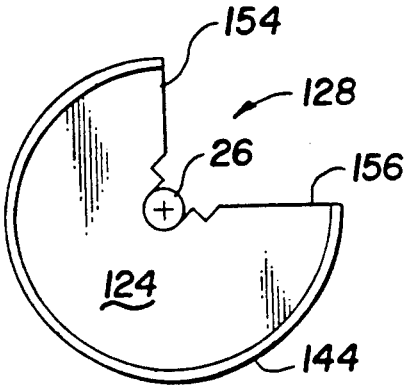
FIG. 4 is a side view of another embodiment of a guide wheel constructed in accordance with the invention.

FIG. 4 illustrates the construction of another paper guide wheel 124 in accordance with the invention wherein the outer surface 144 is of a spiral configuration. The leading edge 154 has a radius smaller than the radius at the trailing edge 156 and all the radii in between are of progressively greater length in moving from the leading edge 154 around the outer surface 144 to the trailing edge 156. The outer surface 144 of the wheel 124 is also preferably crowned and has an opening or notch 128 formed therein to receive a gripper bar in the previously described manner. The spiral wheel 124 may be manufactured by conventional aluminum casting techniques. Alternatively, if warranted by sufficient volume the wheel 124 may be made of a durable plastic constructed using conventional injection molding techniques.

It will be appreciated that as the wheel 124 rotates an air gap is formed between the paper and the outer surface 144 adjacent the leading edge 156 and that the air gap becomes progressively smaller in moving toward the trailing edge 156. It is believed that such a progressively smaller air gap achieved by the spiral construction promotes gradual nesting of the paper against the outer surface 144 in an ideal way. Unlike the embodiments described above which have circular outer surfaces 44 which are eccentric to the axis of rotation, the radius of the spiral outer surface 144 gradually increases even beyond 180 degrees in moving around the wheel 124. In the view of FIG. 4 the increasing spiral extends a full two hundred and seventy degrees and, of course, could extend farther limited only by the space needed for the gripper mechanism. However, a spiral structure such as this is more difficult to manufacture than the simple expedient of forming an eccentric bore in a wheel with a circular outer surface as previously described.

Figure 5:
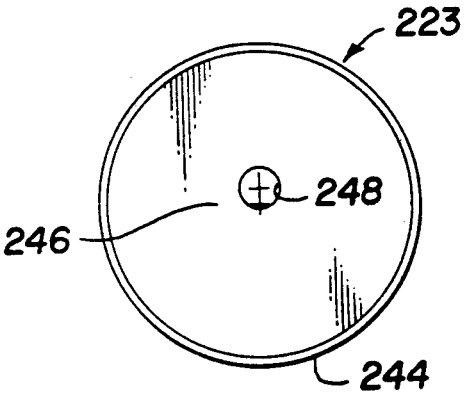
FIGS. 5, 6 and 7 are side views of another embodiment of a guide wheel at different stages of construction in accordance with the invention.
Figure 6:
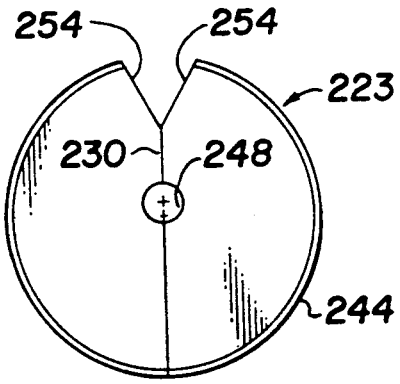
Figure 7:
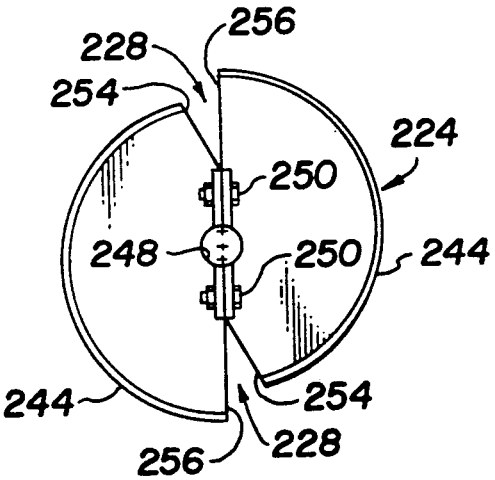

FIGS. 5, 6 and 7 illustrate not only another embodiment of improved paper guide wheel but also illustrate a method of manufacturing such embodiment. The wheel of this embodiment is formed from a wheel blank 223 having a circular outer surface 244 and a central hub portion 246. A bore 248 formed in the hub portion 246 is eccentric with respect to the outer surface 244. FIG. 5 shows the offset center of the bore 248 vertically aligned above the center of the wheel. The outer surface 244 may be cylindrical but is preferably crowned as previously described in connection with guide wheel 24.

In the next manufacturing step the wheel blank 223 is separated into two parts along a diameter 230 which extends through the offset centers as seen in FIG. 6. Portions are cut away leaving edges 254 in each half of the wheel as shown. Then one half of the wheel is simply rotated one hundred and eighty degrees, realigning the halves as shown in FIG. 7 to form a single circular bore 248 for receiving the shaft 26. Fasteners such as those illustrated at 250 are then used to connect the halves of the wheel to form the finished guide wheel 224. The two edges 254 now define the leading edges of two notches 228, with edges 256 being the trailing edges The wheel 224 is made larger in diameter than the previously described wheel 24 so that the two notches 228 seen in FIG. 7 coincide with the positions of corresponding gripper bars.

An inherent feature of the structure of FIG. 7 is that for each half of the wheel 224 the radii defined by the points along the surfaces 244 to the axis of rotation gradually increase uniformly from each leading edge 254 to the corresponding trailing edge 256.

Figure 8A:
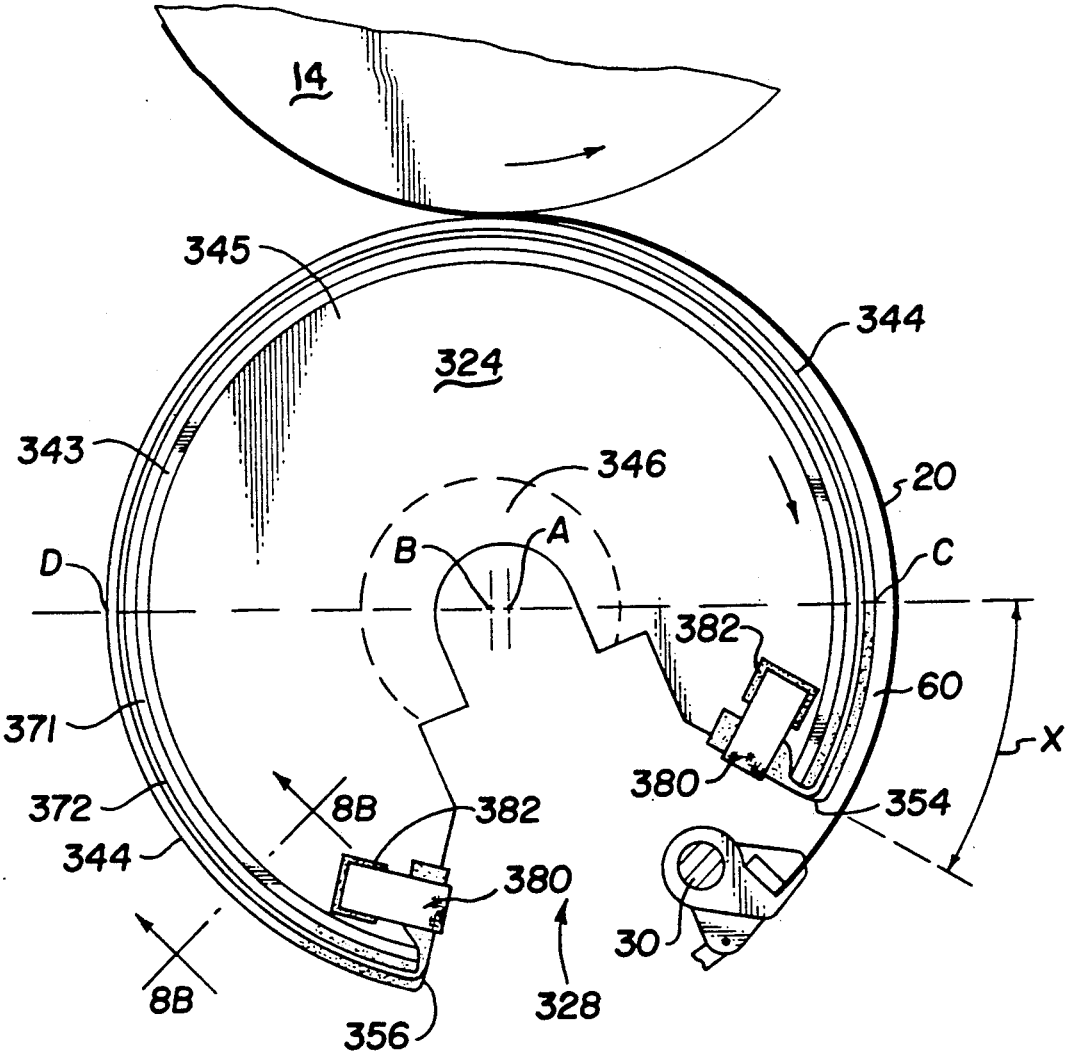
FIG. 8A is a side view of another guide wheel illustrating further improvements in accordance with the invention.
Figure 8B:
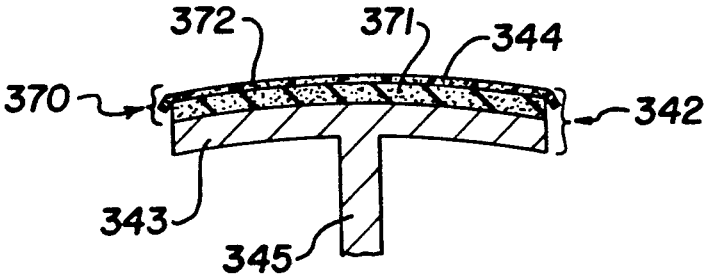
FIG. 8B is a cross-sectional view of a rim portion of the guide wheel of FIG. 8A.

FIGS. 8A and 8B illustrate a guide wheel 324 which is similar in most respects to the guide wheel 24 of FIGS. 3A and 3B with similar reference characters designating similar parts. The essential differences reside in the structure of the rims 342 and 42.

The guide wheel 324 has a rim 342 which includes a rigid flange 343. The flange 343, a radial web portion 345 and a central hub portion 346 preferably are integrally formed parts of an aluminum casting. The rim 342 has a flexible outer portion 370 secured to the supporting flange 343. The portion 370 preferably includes an inner cushion 371 and an outer sheet or jacket 372 which defines the paper-supporting outer surface 344. Preferably, the cushion 371 is adhesively secured to the rigid outer surface of the flange 343 and the foam jacket 372 is snugly wrapped around the cushion and releasably secured at its ends to the wheel 324 within the opening 328.

The jacket 372 preferably consists of polyester foam material or other flexible material with similar properties. The cushion 371 may be any flexible material which may be bonded to the flange 343 and which will provide a compatible supporting base for the jacket 372. For example, the cushion 371 may be made of rubber or plastic but preferably consists of the same polyester foam material as the jacket 372.

Polyester foam provides a superior surface to which the paper gently nests without smearing the freshly inked surface. The small amount of ink which collects on the outer foam surface 344 can easily be removed by the expedient of replacing the foam jacket 372 at regular maintenance intervals.

The flange 343 is preferably slightly crowned in the same manner as the rims of the foregoing embodiments. The flexible foam layers 370 assume approximately the same crowned contour as the flange 343 as depicted in FIG. 8B.

The foam jacket 372 is attached to the wheel 324 for ease of replacement by suitable means such as by straps 380 and pads 382 which are preferably made from the material sold under the trademark VELCRO. One end of the foam jacket 372 is secured by folding the foam over the edge of the web 345 facing the notch 328 at either the leading 354 or trailing edge 356. Then the foam jacket 372 is stretched slightly while wrapping it around the wheel and securing the other end to assure that it does not slip against the adjacent foam cushion 371 and stays firmly in place during operation of the press. The properties of polyester foam are such that an inherent gripping action exists between the jacket 372 and the cushion 371 which keeps the jacket 372 in place.

The VELCRO straps 380, which are attached to the opposite side of the web 345 from that shown in FIG. 8A, are wrapped around the folded-over free ends of the jacket 372 and secured to the respective VELCRO pads 382 which are mounted on the visible side of the web 345. Many other suitable means for releasably attaching the foam jacket 372 securely to the foam cushion 371 other than by VELCRO straps may be employed, such as, for example, any suitable clamping means.

The foam cushion 371 is preferably several times thicker than the foam jacket 372. A jacket thickness of 0.125 inch has been found to be suitable. The preferred thickness range for the cushion 371 is from about 0.375 to about 0.750 inch. It will be appreciated that the diameter of the wheel casting is adjusted to provide the same overall diameter including the foam layers 370 as the diameter of the wheel 24 of FIG. 3A which does not employ foam on the rim.

The tendency for ink to collect on the foam jacket 372 can be reduced significantly by briefly soaking the jacket in an emulsified solution of about twenty percent to about forty percent silicone oil and water, wringing the excess solution out of the jacket and allowing it to dry prior to installation. A suitable silicone oil is dimethylsiloxane.

Optimum results have been achieved with guide wheels having the features of the guide wheel 324 described above in connection with FIGS. 8A and 8B. The areas of the freshly inked paper which contact the foam surface 344 are virtually free of any smearing or scratching of the printed image.

A property of the foam material found to be beneficial to the performance of the guide wheel 324 is its tendency to carry a slight static charge which attracts the paper 20. Even though static electricity generally may be regarded as an undesirable condition in other areas of the printing press, it appears to work to an advantage with guide wheel 324. As the paper 20 gradually approaches the rim 342, it comes under the influence of the static charge and clings to the foam surface 344 without slipping. The paper 20 is carried around the wheel until the paper delivery system pulls the paper free from the foam surface 344 and delivers it to the paper stack in the manner previously described in connection with FIG. 1.

Figure 9:
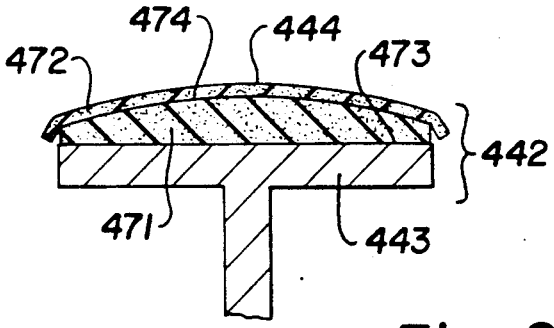
FIG. 9 is a cross-sectional view of a modified rim portion similar to the rim portion of FIG. 8B.

FIG. 9 illustrates a rim structure 442 which is a modification of the rim structure 342 of FIG. 8B. In FIG. 9 the flange 443 has an outer surface 473 which is cylindrical and appears as a straight line in cross-section. A flexible cushion 471 is bonded to the surface 473. The cushion 471 has a variable thickness in the axial direction such that its outer surface 474 assumes a convex or crowned shape when mounted on the flange 443. The foam jacket 472 has a uniform thickness and conforms to the shape of the underlying cushion 471. Thus a crowned outer surface 444 of the jacket 472 is provided in much the same manner and for the same purposes as the outer surface 344 of the embodiment of FIG. 8B. The cushion 471 may be formed using conventional extrusion techniques. The embodiment of FIG. 9 enables retrofitting of guide wheels to provide a paper-supporting outer surface of foam of the desired crowned shape.

Figure 10A:
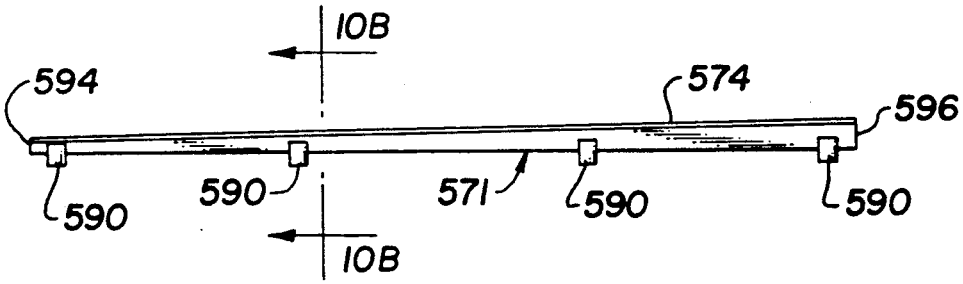
FIG. 10A is a side view of a flexible cushion attachable to a guide wheel in accordance with another embodiment of the invention.
Figure 10B:
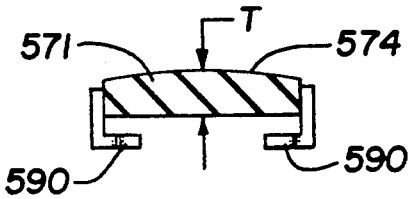
FIG. 10B is a cross-sectional view of the cushion of FIG. 10A.
Figure 10C:
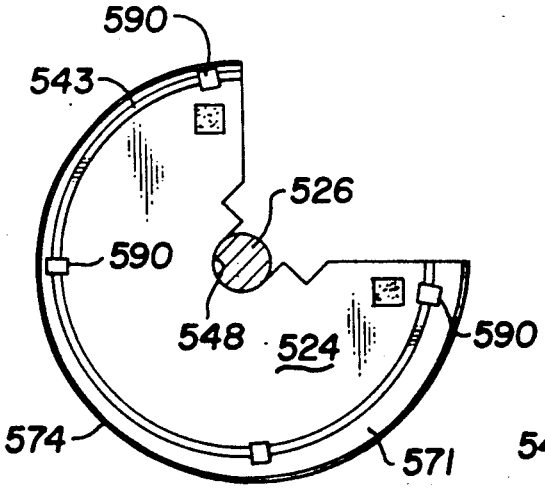
FIGS. 10C and 10D are side views of the guide wheel employing the cushion of FIGS. 10A and 10B at two final stages in the assembly of the guide wheel.
Figure 10D:
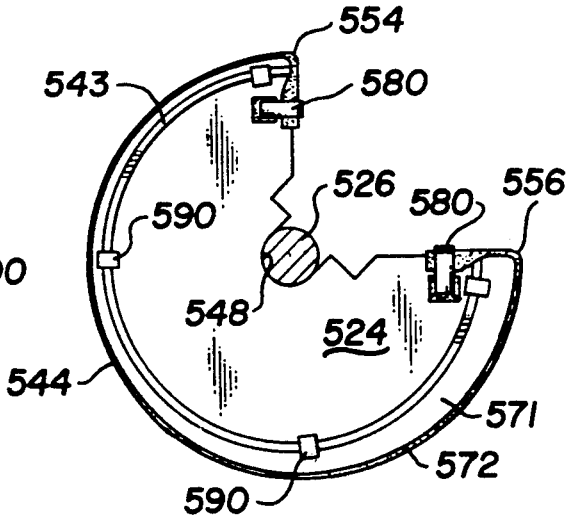

FIGS. 10A–D illustrate another embodiment of the invention which provides a spiral or spiral-like paper-supporting outer surface. The fully assembled guide wheel 524 is shown in FIG. 10D. The wheel 524 has a peripheral flange 543 similar in cross-section to the flange 443 of the embodiment of FIG. 9. The flange 543 is concentric about a central bore 548 and shaft 526 received therein. In order to provide a paper-supporting outer surface 544 of varying radius, a specially adapted cushion 571 is mounted on the flange 543. A foam jacket 572 is wrapped around the cushion and secured at its ends by VELCRO straps 580 in the aforementioned manner.

FIGS. 10A and 10B show the cushion 571 separately as it appears prior to installation on the wheel 524. As seen in FIG. 10A the cushion 571 comprises an elongated member of gradually increasing thickness. The cushion 571 maybe formed from any suitable flexible material and preferably comprises molded synthetic rubber. The cushion is installed by simply wrapping it around the wheel 524 and securing it to the flange 543 by suitable means such as resilient clasps 590 spaced along the cushion 571. FIG. 10B shows two opposed clasps 590 which typify four such pairs at the ends and at two intermediate positions along the cushion 571. The clasps 590 preferably are integrally formed with the body of the cushion 571 and are adapted to resiliently snap in place around the edges of the flange 543 as depicted in FIG. 10C.

The thickness T of the cushion 571 gradually increases from about 0.20 inch at its thin end 594 to about 0.50 inch at its thick end 596 so that its outer surface 574 assumes a spiral shape when installed on the wheel 524 as seen in FIG. 10C. The surface 574 is also crowned in the axial direction as seen in FIG. 10B. The advantages of constructing the guide wheel 524 in this manner will be readily apparent. A concentric wheel blank can be modified to provide a spiral paper-supporting outer surface 544 in which the distance from the axis of rotation to points on the outer surface increases gradually and uniformly while moving around the outer surface in the direction from the leading edge 554 to the trailing edge 556. In other words, the entire outer surface 544 exhibits a gradually increasing radius from the leading edge 554 to the trailing edge 556. Thus an ideally shaped guide wheel can be constructed whereby the paper is allowed to gradually nest against the outer foam surface at a point on the wheel determined by the properties and dimensions of the paper rather than the shape of the wheel. In operation the paper will tend to contact the wheel toward the trailing end of the paper which may be as much as two hundred and seventy degrees around the wheel from the leading edge 554.

Each of the several embodiments described provides an improved guide wheel for a printing press. Although the invention has been described in detail with specific references to preferred embodiments thereof, various changes and modifications can be made thereto without departing from the spirit or scope of the invention as defined by the appended claims.

What is claimed:

1. A wheel for guiding paper in a printing press comprising a rim at the periphery of the wheel, the rim having an outer surface for supporting paper moving through the press and having at least one opening therein extending inwardly toward the center of the wheel with the opening defining a leading edge and a trailing edge at the outer surface, wherein the radial distance from the axis of rotation of the wheel to points on the outer surface increases gradually and uniformly in moving circumferentially around the outer surface from a first point at or near the leading edge to a second point closer to the trailing edge than the leading edge.

2. A wheel as defined in claim 1 wherein the points on the outer surface of the rim define an arc of a circle which is eccentric with respect to the axis of rotation.

3. A wheel as defined in claim 2 wherein the center of the wheel is offset from the axis of rotation by a distance in the range of about 0.125 inch to about 0.175 inch.

4. A wheel as defined in claim 2 wherein the first point lies at the leading edge and the second point lies on the outer surface one hundred and eighty degrees from the leading edge.

5. A wheel as defined in claim 2 wherein the first point lies on the outer surface approximately thirty to forty-five degrees from the leading edge and the second point lies on the outer surface one hundred and eighty degrees from the first point.

6. A wheel as defined in claim 1 wherein the first point lies at the leading edge and the second point lies at the trailing edge.

7. A wheel as defined in claim 6 wherein the points on the outer surface define a spiral.

8. A wheel as defined in claim 7 wherein the spiral subtends at an angle of at least about two hundred and seventy degrees.

9. A wheel as defined in claim 1 wherein the rim includes a second opening disposed one hundred and eighty degrees from the first opening and two opposed circular arcs are defined on the outer surface extending between the openings, the circular arcs being eccentric with respect to each other and the axis of rotation of the wheel.

10. A wheel as defined in claim 1 wherein the outer surface of the rim is slightly curved in the axial direction to define a convex surface between the axially extreme edges of the rim.

11. A wheel as defined in claim 10 wherein the ratio of the axial width of the rim to the radial height of the convex surface is about 100 to 1.

12. A wheel as defined in claim 1 wherein the rim comprises foam material defining the outer surface.

13. A wheel as defined in claim 12 wherein the rim has a rigid supporting surface and the foam material consists of a foam cushion adhesively bonded to the rigid supporting surface and a replaceable foam jacket stretched over the foam cushion.

14. A wheel as defined in claim 12 wherein the foam material consists essentially of polyester foam.

15. A guide wheel for supporting and transferring paper sheets between successive processing stations in a printing press without smearing the ink on freshly inked surfaces of the paper where contact is made with the wheel, said guide wheel comprising:

a rim having an outer surface for supporting the paper sheets, said rim having an opening therein extending axially across the wheel so that the outer surface extends circumferentially less than three hundred and sixty degrees; and a hub connected to the rim and mountable on a shaft driven by the press for rotating the wheel about an axis wherein the distance between the axis and outer surface increases gradually outwardly from a first point at or near the opening to a second point substantially removed from the opening while moving around the outer surface in the direction opposite the direction of rotation of the guide wheel.

16. A guide wheel as defined in claim 15 wherein the outer surface of the rim is slightly curved in the axial direction to define a convex surface between the axially extreme edges of the rim.

17. A guide wheel as defined in claim 15 wherein the rim comprises foam material defining the outer surface.

18. A guide wheel as defined in claim 17 wherein said foam material comprises a replaceable foam jacket.

19. A guide wheel for a printing press comprising a generally annular flange; a flexible cushion affixed to the outer surface of the flange; a foam jacket disposed on the cushion and defining a paper-supporting outer surface; and means for releasably attaching the foam jacket securely to the cushion to prevent relative movement between the jacket and the cushion.

20. A guide wheel as defined in claim 19 wherein the material of the jacket consists essentially of polyester foam.

* * * * *

UNITED STATES PATENT AND TRADEMARK OFFICE

CERTIFICATE OF CORRECTION

PATENT NO. : 5,090,686

DATED : February 25, 1992

INVENTOR(S) : Norman H. Kemp

It is certified that error appears in the above-identified patent and that said Letters Patent is hereby corrected as shown below:

On the title page:
Correct the Inventors field to read as follows:

[76] Inventor: Norman H. Kemp, 3216 Oakdale Dr.,
Hurst, Texas 76054

Column 1, line 66, change "per se" to ---per se---

Signed and Sealed this
First Day of June, 1993

*Attest:*

Michael K. Kirk

MICHAEL K. KIRK

*Attesting Officer*

*Acting Commissioner of Patents and Trademarks*

US005090686A

REEXAMINATION CERTIFICATE (2665th)

United States Patent [19]

Kemp

[11] B1 5,090,686

[45] Certificate Issued Sep. 5, 1995

[54] PAPER GUIDE WHEEL

[76] Inventor: Norman H. Kemp, 3216 Oakdale Dr., Hurst, Tex. 76054

Reexamination Request:
No. 90/003,569, Sep. 14, 1994

Reexamination Certificate for:

| | |
|---|---|
| Patent No.: | **5,090,686** |
| Issued: | **Feb. 25, 1992** |
| Appl. No.: | **501,019** |
| Filed: | **Mar. 29, 1990** |

Certificate of Correction issued Jun. 1, 1993.

Related U.S. Application Data

[60] Division of Ser. No. 281,521, Dec. 8, 1988, Pat. No. 4,973,040, which is a continuation of Ser. No. 152,896, Feb. 5, 1988, abandoned.

[51] Int. Cl.[6] ..... B65H 5/02

[52] U.S. Cl. ..... 271/277; 101/422; 101/419

[58] Field of Search ..... 271/277, 275, 270, 82, 271/204, 205, 206; 101/409–412, 422, 420, 419

[56] References Cited

U.S. PATENT DOCUMENTS

| | | | |
|---|---|---|---|
| 687,575 | 11/1901 | Roesen | 101/422 |
| 2,220,046 | 10/1940 | Lang | 271/270 |
| 2,410,611 | 5/1945 | Pratt et al. | 271/275 |
| 3,642,274 | 2/1972 | Herrington et al. | 271/79 |
| 3,690,648 | 9/1972 | Herrington et al. | 271/51 |
| 3,791,644 | 2/1974 | DeMoore | 271/80 |
| 3,918,707 | 11/1975 | Villemer et al. | 271/277 |
| 4,004,512 | 1/1977 | Jeschke | 101/410 |
| 4,024,814 | 5/1977 | Becker | 101/410 |
| 4,334,473 | 6/1982 | Becker et al. | 101/409 |
| 4,395,949 | 8/1983 | Jeschke | 101/420 |
| 4,402,267 | 9/1983 | DeMoore | 101/419 |
| 4,691,632 | 9/1987 | DeMoore | 101/426 |

FOREIGN PATENT DOCUMENTS

| | | | |
|---|---|---|---|
| 3507925 | 9/1986 | Germany | 101/409 |
| 3507925 | 9/1986 | Germany . | |

*Primary Examiner*—Kenneth Noland

[57] ABSTRACT

A paper guide wheel for printing presses is formed to include an outer surface eccentric with respect to the axis of rotation of the wheel so as to form an air gap between the outer surface of the wheel and the paper as the paper is drawn thereover during movement through the press. The air gap gradually narrows as the wheel turns, allowing the freshly inked surface of the paper to gently nest against the outer surface at a point removed from the leading edge of the paper. The outer surface has a slightly convex contour in the axial direction to avoid marking of the paper by contact with the axial extremes of the outer surface. Foam material may be provided on the wheel rim to assist in supporting the paper without marking the freshly inked image.

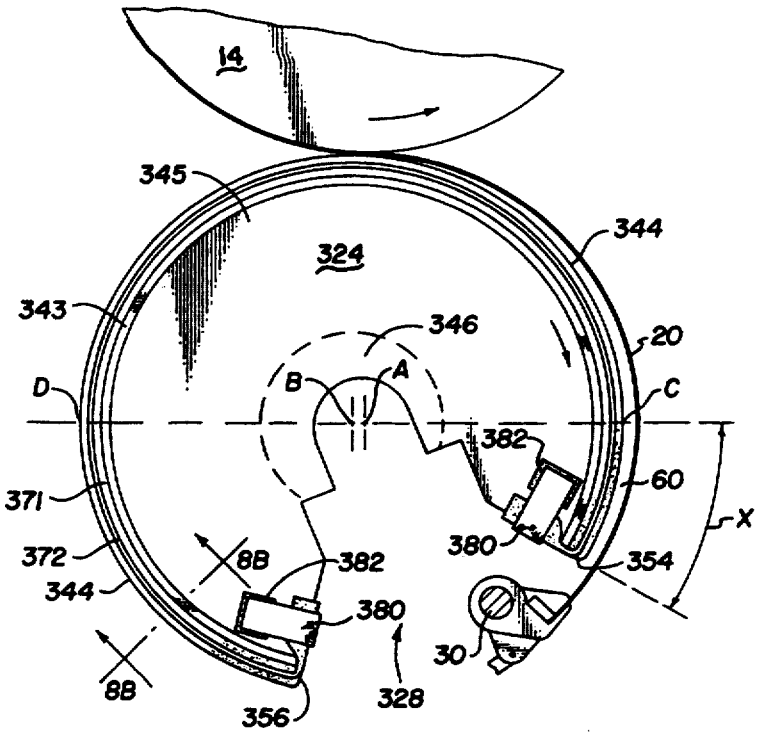

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–20 is confirmed.

* * * * *